US010233054B2

(12) United States Patent
Ishiguro et al.

(10) Patent No.: US 10,233,054 B2
(45) Date of Patent: Mar. 19, 2019

(54) ELEVATOR CAR UPPER HANDRAIL APPARATUS

(71) Applicant: MITSUBISHI ELECTRIC CORPORATION, Chiyoda-ku (JP)

(72) Inventors: Takahide Ishiguro, Chiyoda-ku (JP); Naoyuki Maruyama, Chiyoda-ku (JP); Hironobu Kamada, Chiyoda-ku (JP); Hideki Miyahara, Chiyoda-ku (JP); Kazuya Shindo, Inazawa (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 15/741,779

(22) PCT Filed: Jul. 23, 2015

(86) PCT No.: PCT/JP2015/070948
§ 371 (c)(1),
(2) Date: Jan. 4, 2018

(87) PCT Pub. No.: WO2017/013784
PCT Pub. Date: Jan. 26, 2017

(65) Prior Publication Data

US 2018/0201478 A1 Jul. 19, 2018

(51) Int. Cl.
*B66B 5/00* (2006.01)
*B66B 11/02* (2006.01)
(Continued)

(52) U.S. Cl.
CPC ..... *B66B 5/0081* (2013.01); *B66B 11/0246* (2013.01); *E05F 1/12* (2013.01);
(Continued)

(58) Field of Classification Search
CPC ..... B66B 11/0246; B66B 5/0081; E05F 1/12; E06B 11/021; E06B 11/022
See application file for complete search history.

(56) References Cited

U.S. PATENT DOCUMENTS 6,477,736 B1 * 11/2002 Abernathy ..... E05F 1/1016 16/72
6,543,584 B1 * 4/2003 Miyakoshi ..... B66B 5/0081 182/113

(Continued)

FOREIGN PATENT DOCUMENTS

JP 2007-261788 A 10/2007
JP 2011-093618 A 5/2011

OTHER PUBLICATIONS

International Search Report dated Oct. 27, 2015 in PCT/JP2015/070948, filed on Jul. 23, 2015.

*Primary Examiner* — Michael A Riegelman
(74) *Attorney, Agent, or Firm* — Xsensus LLP

(57) ABSTRACT

An elevator car upper handrail apparatus, in which a connecting body is provided between respective ends of first and second side handrails on a landing side. The connecting body includes an opening/closing member which is rotatable between a closed position, in which a path for movement of a worker from a landing to a car upper surface is closed by the opening/closing member, and an open position, in which the path for movement is opened by the opening/closing member. The opening/closing member is configured to return automatically to the closed position. When the opening/closing member is in the closed position, the connecting body transmits an external force applied to one of the first and second side handrails in the width direction of a car to the other of the first and second side handrails.

19 Claims, 13 Drawing Sheets

(51) Int. Cl.
*E05F 1/12* (2006.01)
*E06B 11/02* (2006.01)

(52) U.S. Cl.
CPC ..... *E06B 11/021* (2013.01); *E06B 11/022* (2013.01); *E05Y 2201/484* (2013.01); *E05Y 2900/402* (2013.01)

(56) References Cited

U.S. PATENT DOCUMENTS

| | | | | |
|---|---|---|---|---|
| 6,830,127 | B2 * | 12/2004 | Johnson | E02D 29/12 182/113 |
| 8,365,870 | B2 * | 2/2013 | Sirigu | B66B 5/0068 187/306 |
| 2007/0051934 | A1 * | 3/2007 | LaCook | E06B 11/02 256/73 |
| 2008/0217113 | A1 * | 9/2008 | Bonatre | B66B 5/0081 187/401 |
| 2008/0256865 | A1 * | 10/2008 | Trujillo | E06B 3/46 49/55 |
| 2013/0086842 | A1 * | 4/2013 | Morrone, III | E06B 9/063 49/55 |
| 2013/0092479 | A1 * | 4/2013 | Bloch | B66B 5/0081 187/401 |
| 2013/0219790 | A1 * | 8/2013 | Honeycutt | E06B 11/045 49/176 |
| 2014/0318721 | A1 * | 10/2014 | Pedersen | E05B 65/0014 160/210 |
| 2017/0297870 | A1 * | 10/2017 | Fauconnet | B66B 11/0226 |
| 2018/0002139 | A1 * | 1/2018 | Stepp | B66B 11/0226 |
| 2018/0111797 | A1 * | 4/2018 | Fauconnet | B66B 11/0253 |
| 2018/0112413 | A1 * | 4/2018 | Palasek | E04D 13/0335 |
| 2018/0222723 | A1 * | 8/2018 | Gressien | B66B 5/0087 |
| 2018/0282127 | A1 * | 10/2018 | Fauconnet | B66B 11/0246 |

* cited by examiner

ELEVATOR CAR UPPER HANDRAIL APPARATUS

TECHNICAL FIELD

The present invention relates to an elevator car upper handrail apparatus which is erected on a car upper surface and prevents a worker from falling.

BACKGROUND ART

In a conventional car upper handrail apparatus, a pair of first handrails are erected on both sides of a car upper surface, i.e. one on the left side and one on the right side. Also, a pair of second handrails are respectively connected to ends of the first handrails on a side opposite to a landing. Further, a gap between ends of the first handrails on a landing side is simply left open, as no member for connecting the ends of the first handrails on the landing side is used (see PTL 1, for example).

In another conventional car upper handrail apparatus, a handle post is erected between ends of first and second side handrails erected on both sides of a car upper surface on a landing side, i.e. one on the left side and one on the right side. A first connection bracket is provided between an upper end of the handle post and the first side handrail. A handle bar and a second connection bracket are provided between the upper end of the handle post and the second side handrail.

A proximal end of the first connection bracket is connected, so as to be freely rotatable, to the first side handrail. A distal end of the first connection bracket is locked onto a first pin provided on the handle post. A proximal end of the second connection bracket is connected, so as to be freely rotatable, to the second side handrail. A distal end of the second connection bracket is locked onto a second pin provided on the handle bar (see PTL 2, for example).

CITATION LIST

Patent Literature

[PTL 1] Japanese Patent Application Publication No. 2007-261788

[PTL 2] Japanese Patent Application Publication No. 2011-93618

SUMMARY OF THE INVENTION

Problem to be Solved by the Invention

In the conventional car upper handrail apparatus disclosed in PTL 1, no reinforcing member is used to connect the ends of the first handrails on the landing side, hence, supposing that a force will be applied, in a width direction of the car, to one or both of the first handrails on the landing side of the car upper surface, it is necessary to increase the rigidity of each of the first handrails, which results in an increase in component size and weight.

On the other hand, in the conventional car upper handrail apparatus disclosed in PTL 2, the ends of the first and second side handrails on the landing side are connected to each other, hence a load can be split between the first and second side handrails, as a result the first and second side handrails can be reduced in size and weight. However, when a worker enters/exits the car upper surface, it is necessary for the first or second connection bracket to be released from the first or second pin and rotated, and then for the first or second connection bracket to be rotated back to an original position and locked back onto the pin, which results in a decline in workability. Moreover, should the worker forget to lock the first and second connection brackets onto the first and second pins, the strength required of the first and second side handrails may not be secured.

The present invention has been made to solve the problems described above, and an object thereof is to obtain an elevator car upper handrail apparatus in which the strength required of first and second side handrails can be more reliably secured while the weight thereof is reduced, and in which a decline in workability when a worker enters/exits a car upper surface can be prevented.

Means for Solving the Problem

An elevator car upper handrail apparatus according to the present invention is provided with first and second side handrails erected respectively along left and right edges of a car upper surface when viewed from a landing side, and a connecting body provided between respective ends of the first and second side handrails on the landing side, wherein the connecting body includes an opening/closing member which is rotatable between a closed position, in which a path for movement of a worker from a landing to the car upper surface is closed by the opening/closing member and an open position, in which the path for movement is opened by the opening/closing member, the opening/closing member is configured to return automatically to the closed position, and when the opening/closing member is in the closed position, the connecting body transmits an external force applied to one of the first and second side handrails in the width direction of a car to the other of the first and second side handrails.

Effects of the Invention

In the elevator car upper handrail apparatus according to the present invention, a connecting body is provided with an opening/closing member which is rotatable between a closed position and an open position, the opening/closing member is configured to return automatically to the closed position, and when the opening/closing member is in the closed position, the connecting body transmits an external force applied to one of the first and second side handrails in the width direction of a car to the other of the first and second side handrails, hence, the strength required of the first and second side handrails can be more reliably secured while the weight thereof is reduced, and a decline in workability when a worker enters/exits the car upper surface can be prevented.

DESCRIPTION OF EMBODIMENTS

Embodiments of the present invention will be described hereinafter with reference to the drawings.

First Embodiment

Figure 1:
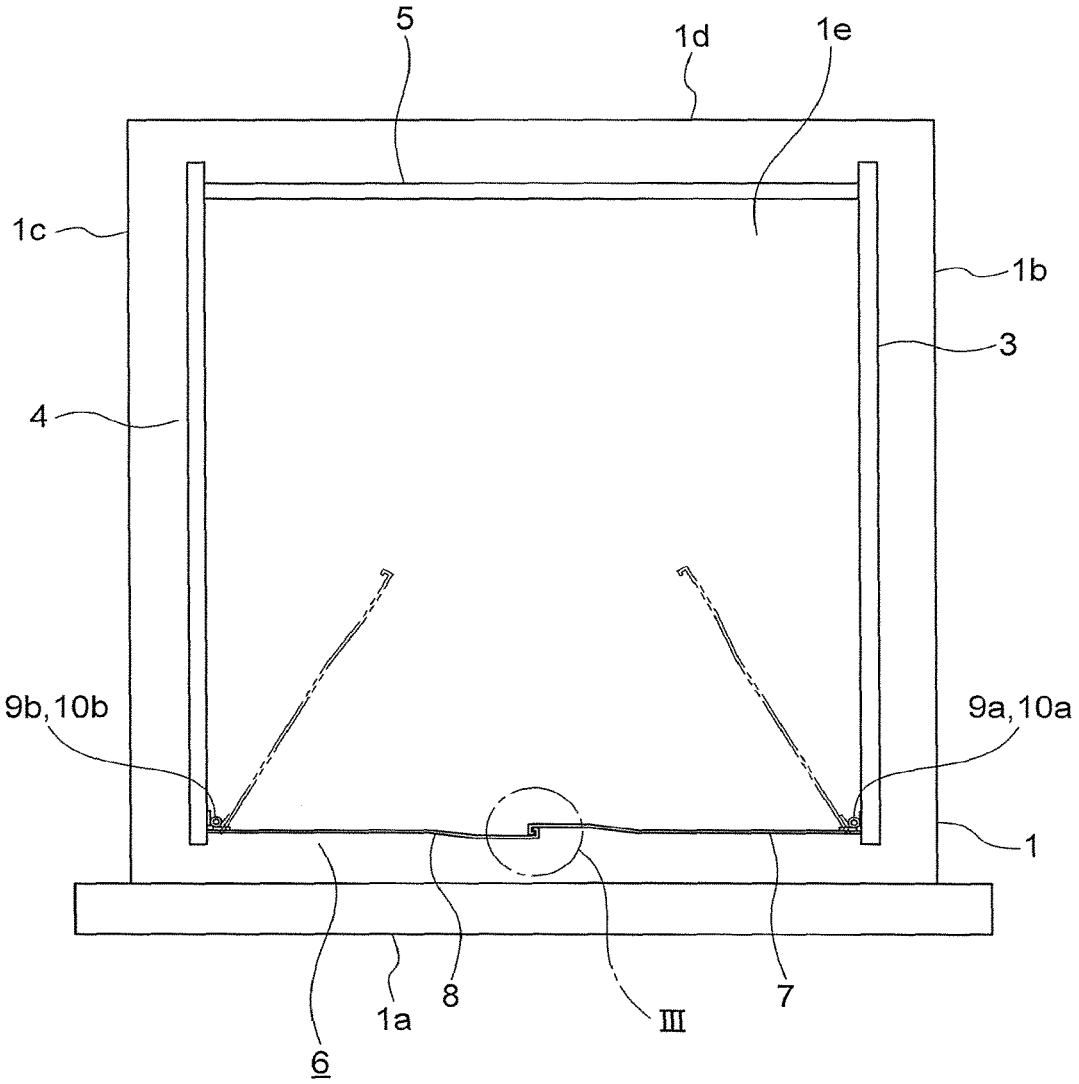
FIG. 1 is a plan view showing an elevator car upper handrail apparatus according to a first embodiment of the present invention.
Figure 2:
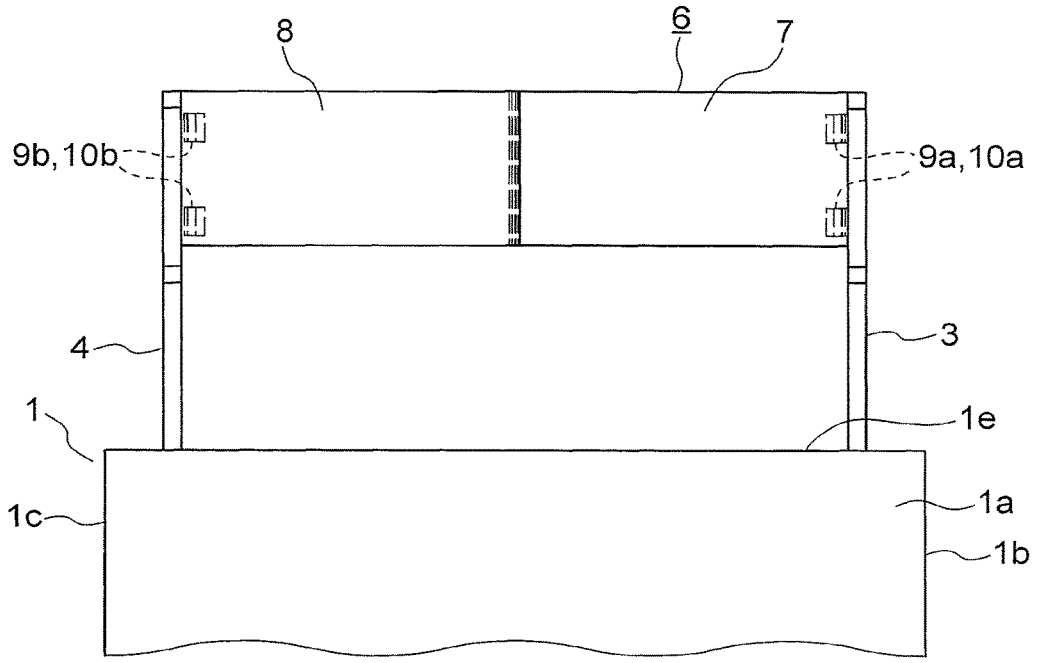
FIG. 2 is a front view of the car upper handrail apparatus shown in FIG. 1.

FIG. 1 is a plan view showing an elevator car upper handrail apparatus according to a first embodiment of the present invention, and FIG. 2 is a front view of the car upper handrail apparatus shown in FIG. 1 (viewed from a landing side). In the figures, a car 1 includes a car front surface 1*a* which is provided with a car entrance (not shown), a pair of car side surfaces 1*b* and 1*c* which oppose each other, a car rear surface 1*d* which opposes the car front surface 1*a*, and a car upper surface 1*e*.

The car 1 is suspended in a hoistway from a suspending body (not shown), and ascends/descends in the hoistway due to the driving force of a hoisting machine (not shown).

A car upper handrail apparatus, which prevents a worker from falling when the worker performs work on the car 1, is installed on the car 1. The car upper handrail apparatus includes first and second side handrails 3 and 4 which are erected vertically along left and right edges of the car upper surface 1*e* when viewed from a landing side, a rear handrail 5 fixed between ends of the first and second side handrails 3 and 4 on an opposite side to the landing, and a connecting body 6 provided between ends of the first and second side handrails 3 and 4 on a landing side.

The configuration of the second side handrail 4 is the same as that of the first side handrail 3. Further, the structure for fixing the second side handrail 4 to the car 1 is the same as that for fixing the first side handrail 3 to the car 1.

The connecting body 6 includes first and second flat plate-shaped opening/closing members 7 and 8. A proximal end of the first opening/closing member 7 is connected, so as to be rotatable, to the end of the first side handrail 3 on the landing side via a plurality of hinges 9*a*. A proximal end of the second opening/closing member 8 is connected, so as to be rotatable, to the end of the second side handrail 4 on the landing side via a plurality of hinges 9*b*.

The first and second opening/closing members 7 and 8 are rotatable, about a vertical axis, between a closed position (the solid line shown in FIG. 1), in which the path for movement of a worker from the landing to the car upper surface 1*e* is intersected and closed, and an open position (the two-dot chain line shown in FIG. 1), in which the path for movement is opened. Further, the first and second opening/closing members 7 and 8 are normally in the closed position, but rotate towards an open position due to being pushed by a worker.

Further, a plurality of torsion springs 10*a* which apply, to the first opening/closing member 7, a force to return the first opening/closing member 7 to the closed position, are provided at the proximal end of the first opening/closing member 7. A plurality of torsion springs 10*b* which apply, to the second opening/closing member 8, a force to return the second opening/closing member 8 to the closed position are provided at the proximal end of the second opening/closing member 8. As a result, the first and second opening/closing members 7 and 8 automatically return to the closed position when an external force that acts to rotate the first and second opening/closing members 7 and 8 from the closed position towards the open position is removed.

Figure 3:
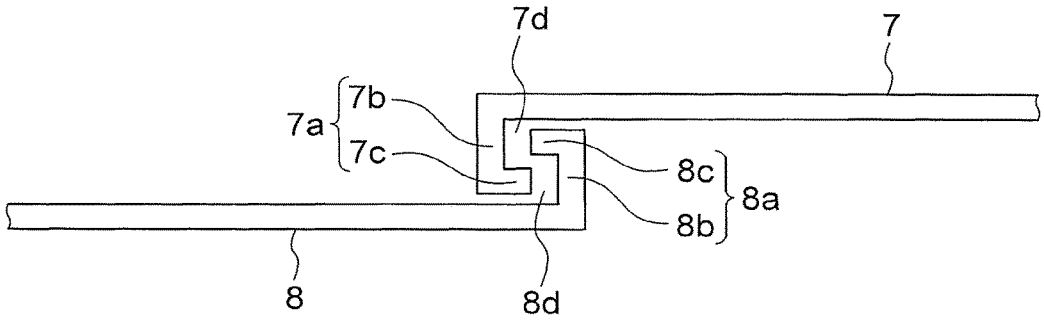
FIG. 3 is an enlarged plan view of portion III shown in FIG. 1.

FIG. 3 is an enlarged plan view of portion III shown in FIG. 1. A first connecting portion 7*a* is provided at the distal end of the first opening/closing member 7. The first connecting portion 7*a* is formed by bending the distal end of the first opening/closing member 7 into a U shape.

The first connecting portion 7*a* includes a first opposing portion 7*b* formed by bending the distal end of the first opening/closing member 7 perpendicularly towards the landing, and a first folded-back portion 7*c* formed by bending the distal end of the first opposing portion 7*b* perpendicularly towards a proximal end of the first opening/closing member 7. A first concave portion 7*d*, which is continuous in the vertical direction, is formed at an inner side of the first connecting portion 7*a*.

A second connecting portion 8*a* is provided in an area, which is overlapped by the first connecting portion 7*a* when the first opening/closing member 7 is in the closed position or, in other words, at the distal end of the second opening/closing member 8. The second connecting portion 8*a* is formed by bending the distal end of the second opening/closing member 8 into a U shape. The first and second connecting portions 7*a* and 8*a* constitute catching portions each having an angle of 90° or more.

The second connecting portion 8*a* includes a second opposing portion 8*b* formed by bending the distal end of the second opening/closing member 8 perpendicularly towards a side opposite to the landing, and a second folded-back portion 8*c* formed by bending the distal end of the second opposing portion 8*b* perpendicularly towards a proximal end of the second opening/closing member 8. A second concave portion 8*d*, which is continuous in the vertical direction, is formed at an inner side of the second connecting portion 8*a*.

The length dimension of the second opening/closing member 8 in the width direction (the left-right direction in FIG. 3) of the car 1 is the same as that of the first opening/closing member 7 in the width direction. The first and second connecting portions 7*a* and 8*a* are arranged at the center of the car 1 in the width direction thereof.

When the first and second opening/closing members 7 and 8 are in the closed position, the first and second connecting portions 7*a* and 8*a* do not overlap each other when viewed from the landing side. However, the first and second connecting portions 7*a* and 8*a* do overlap each other when viewed along the width direction of the car 1.

Further, when the first and second opening/closing members 7 and 8 are in the closed position, the first folded-back portion 7*c* is positioned outside the second concave portion 8*d*, and the second folded-back portion 8*c* is positioned outside the first concave portion 7*d*. In other words, the first and second connecting portions 7*a* and 8*a* are normally oppose each other via a gap in the width direction of the car 1 so as to allow rotation of the opening/closing members 7 and 8 from the closed position towards an open position.

Figure 4:
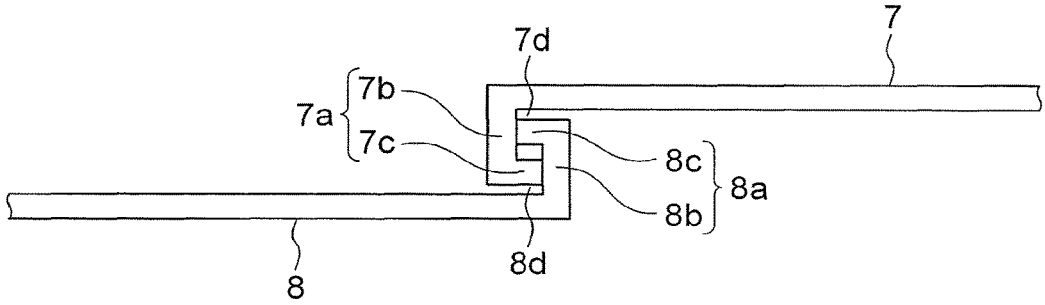
FIG. 4 is a plan view of a state in which the first and second opening/closing members shown in FIG. 3 are connected to each other.

Further, the first and second connecting portions 7*a* and 8*a* come into contact with each other, as shown in FIG. 4, due to at least one of the first and second side handrails 3 and 4 being displaced in the width direction of the car 1, whereby an external force applied in the width direction of the car 1 is transmitted therebetween. In the state shown in FIG. 4, the first folded-back portion 7*c* enters the second concave portion 8*d* and comes into contact with the second opposing portion 8*b* and the second folded-back portion 8*c* enters the first concave portion 7*d* and comes into contact with the first opposing portion 7*b*.

With such a car upper handrail apparatus, a worker can easily move onto the car upper surface 1*e* by simply rotating the first and second opening/closing members 7 and 8, such that a decline in workability when the worker enters/exits the car upper surface 1*e* can be prevented.

Further, when, for example, a worker working close to the landing pushes the first side handrail 3 towards an outer side of the car 1 for some reason, the first side handrail 3 collapses towards the outer side of the car 1 proportionately to the load acting thereon. When the extent to which the first side handrail 3 collapses becomes equal to or greater than a gap between the first and second connecting portions 7*a* and 8*a*, the first and second opening/closing members 7 and 8 are connected to each other via the first and second connecting portions 7*a* and 8*a*.

As a result, the load supported by the first side handrail 3 is transmitted to the second side handrail 4 via the first and second connecting portions 7*a* and 8*a* so as to be supported by both the left and right side handrails 3 and 4. In this state, twice the load can be supported in comparison to when a load is supported by the first side handrail 3 alone.

Further, the first and second opening/closing members 7 and 8 are configured to return automatically to the closed position. Accordingly, the strength required of the first and second side handrails 3 and 4 can be more reliably secured while the weight thereof is reduced.

Moreover, as the first and second connecting portions 7*a* and 8*a* are formed by bending the respective distal ends of the first and second opening/closing members 7 and 8, the configurations thereof are simple.

Further, as the proximal end of the first opening/closing member 7 is connected to the first side handrail 3 and the proximal end of the second opening/closing member 8 is connected to the second side handrail 4, it is possible for a worker to move onto the car upper surface 1*e* via the wide area between the first and second side handrails 3 and 4, whereby workability is improved.

Second Embodiment

Figure 5:
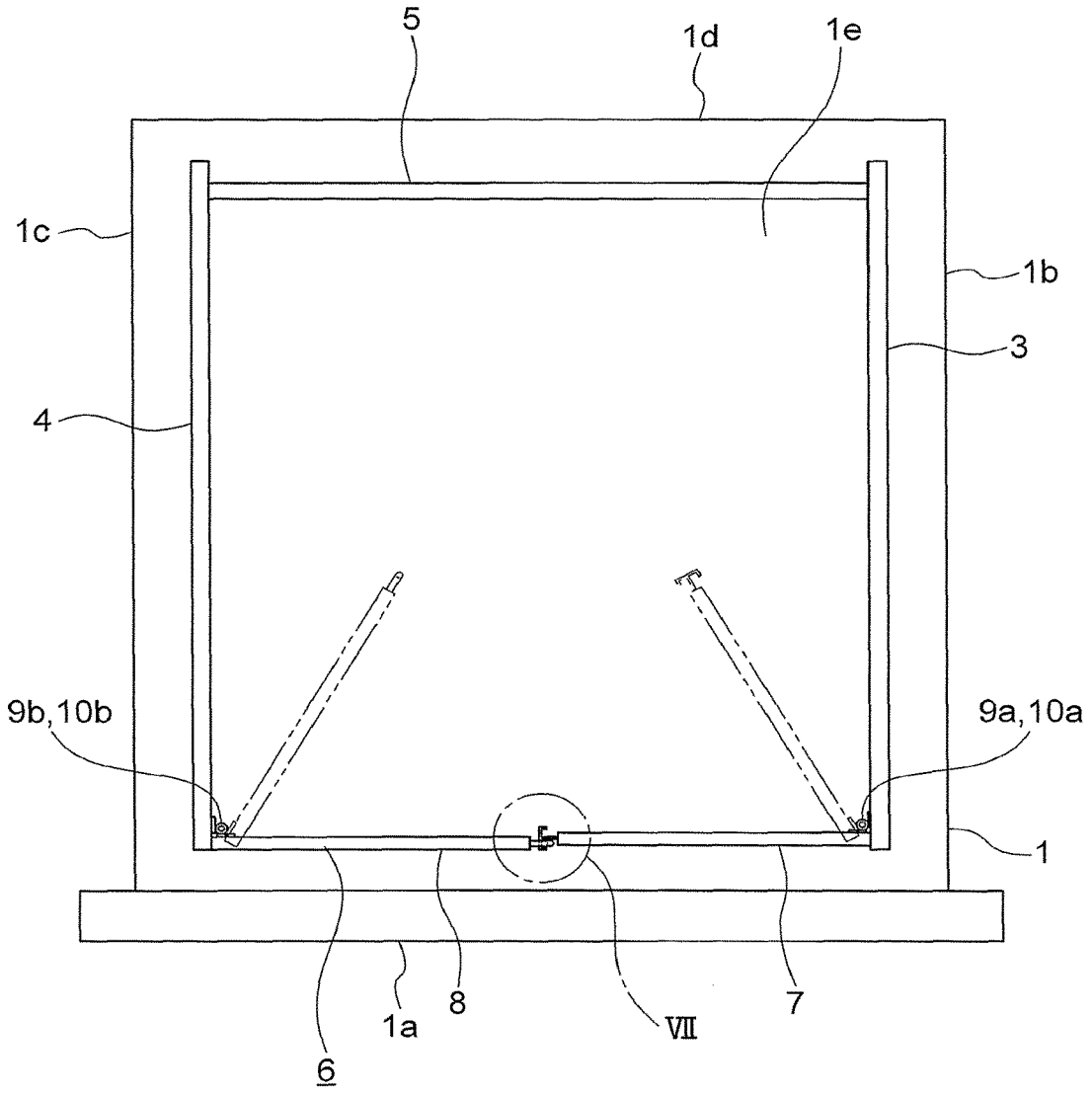
FIG. 5 is a plan view showing an elevator car upper handrail apparatus according to a second embodiment of the present invention.
Figure 6:
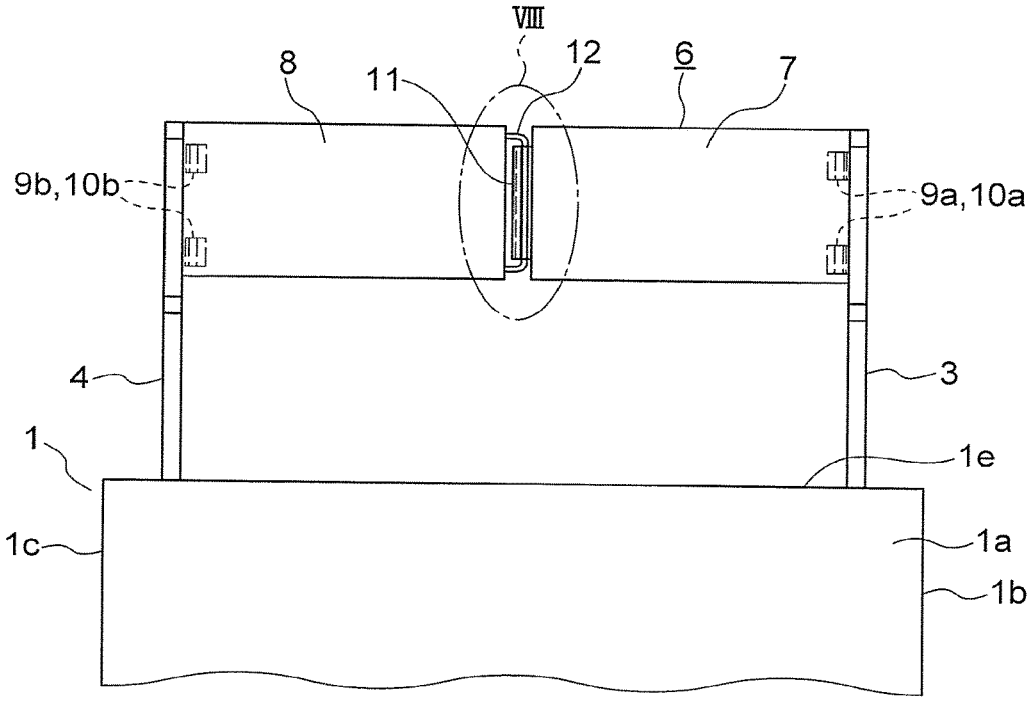
FIG. 6 is a front view of the car upper handrail apparatus shown in FIG. 5.
Figure 7:
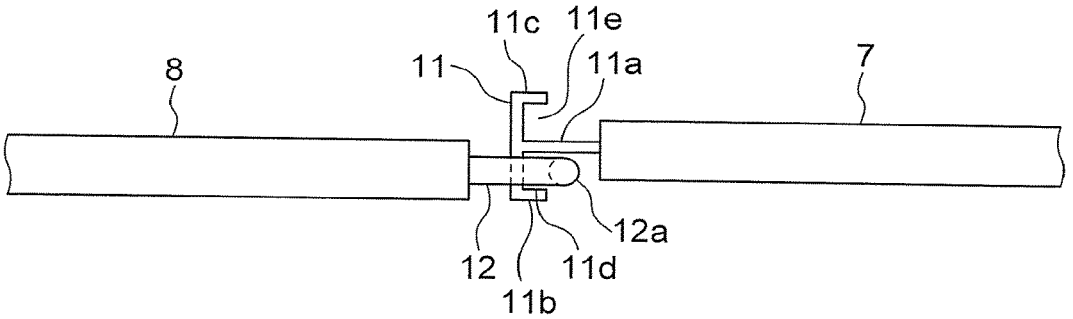
FIG. 7 is an enlarged plan view of portion VII shown in FIG. 5.
Figure 8:
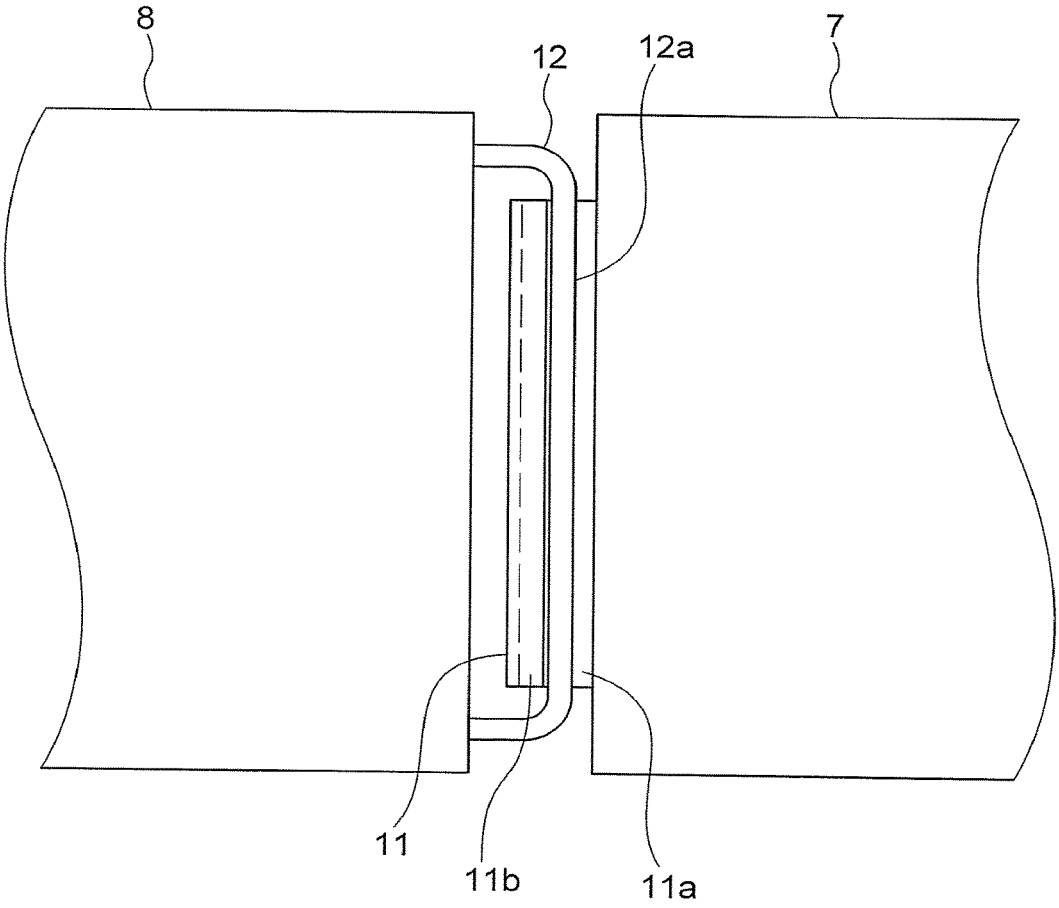
FIG. 8 is an enlarged front view of portion VIII shown in FIG. 6.

FIG. 5 is a plan view showing an elevator car upper handrail apparatus according to a second embodiment of the present invention, FIG. 6 is a front view of the car upper handrail apparatus shown in FIG. 5, FIG. 7 is an enlarged plan view of portion VII shown in FIG. 5, and FIG. 8 is an enlarged front view of portion VIII shown in FIG. 6.

In the second embodiment, a first connecting portion 11 is fixed to the distal end of the first opening/closing member 7. The first connecting portion 11 includes a fixing portion 11*a* fixed to the first opening/closing member 7 and first and second L-shaped hook portions 11*b* and 11*c* which project respectively from a distal end of the fixing portion 11*a* towards both sides of the first opening/closing member 7 in an opening/closing direction.

A first concave portion 11*d*, which is continuous in the vertical direction, is formed at an inner side of the fixing portion 11*a* and the first hook portion 11*b*. A second concave portion 11*e*, which is continuous in the vertical direction, is formed at an inner side of the fixing portion 11*a* and the second hook portion 11*c*. The first and second hook portions 11*b* and 11*c* constitute catching portions each having an angle of 90° or more.

A second connecting portion 12 is fixed to the distal end of the second opening/closing member 8. The second connecting portion 12 is provided in an area that is overlapped by the first connecting portion 11 when the first and second opening/closing members 7 and 8 are in the closed position. Further, the second connecting portion 12 includes a vertical connecting rod 12*a* which selectively opposes one of the first and second hook portions 11*b* and 11*c* when the first and second opening/closing members 7 and 8 are in the closed position.

Further, when the first and second opening/closing members 7 and 8 are in the closed position, the connecting rod 12*a* does not overlap the first and second hook portions 11*b* and 11*c* when viewed from the landing side. However, the connecting rod 12*a* does overlap the first or second hook portion 11*b* or 11*c* when viewed along the width direction of the car 1.

Further, when the first and second opening/closing members 7 and 8 are in the closed position, the connecting rod 12*a* is positioned outside the first and second concave portions 11*d* and 11*e*. In other words, the first and second connecting portions 11 and 12 normally oppose each other via a gap in the width direction of the car 1 so as to allow rotation of the opening/closing members 7 and 8 from the closed position towards an open position.

Further, the first and second connecting portions 11 and 12 come into contact with each other due to at least one of the first and second side handrails 3 and 4 being displaced in the width direction of the car 1, whereby an external force applied in the width direction of the car 1 is transmitted therebetween. In such a state, the connecting rod 12*a* enters the first or second concave portion 11*d* or 11*e* and comes into contact with the first or second hook portion 11*b* or 11*c*. All other configurations and operations are similar or identical to the first embodiment.

Such connecting portions 11 and 12 also allow the strength required of first and second side handrails 3 and 4 to be more reliably secured while the weight thereof is reduced, and allow a decline in workability, when a worker enters/exits the car upper surface 1*e*, to be prevented.

Moreover, when the first and second opening/closing members 7 and 8 return to the closed position from a state of being rotated towards the open position, the first and second connecting portions 11 and 12 can be connected to each other regardless of which of the first and second opening/closing members 7 and 8 returns to the closed position first.

Note that, in the first and second embodiments, the dimensions of the first and second opening/closing members 7 and 8 in the width direction of the car 1 are the same, but may be different.

Third Embodiment

Figure 9:
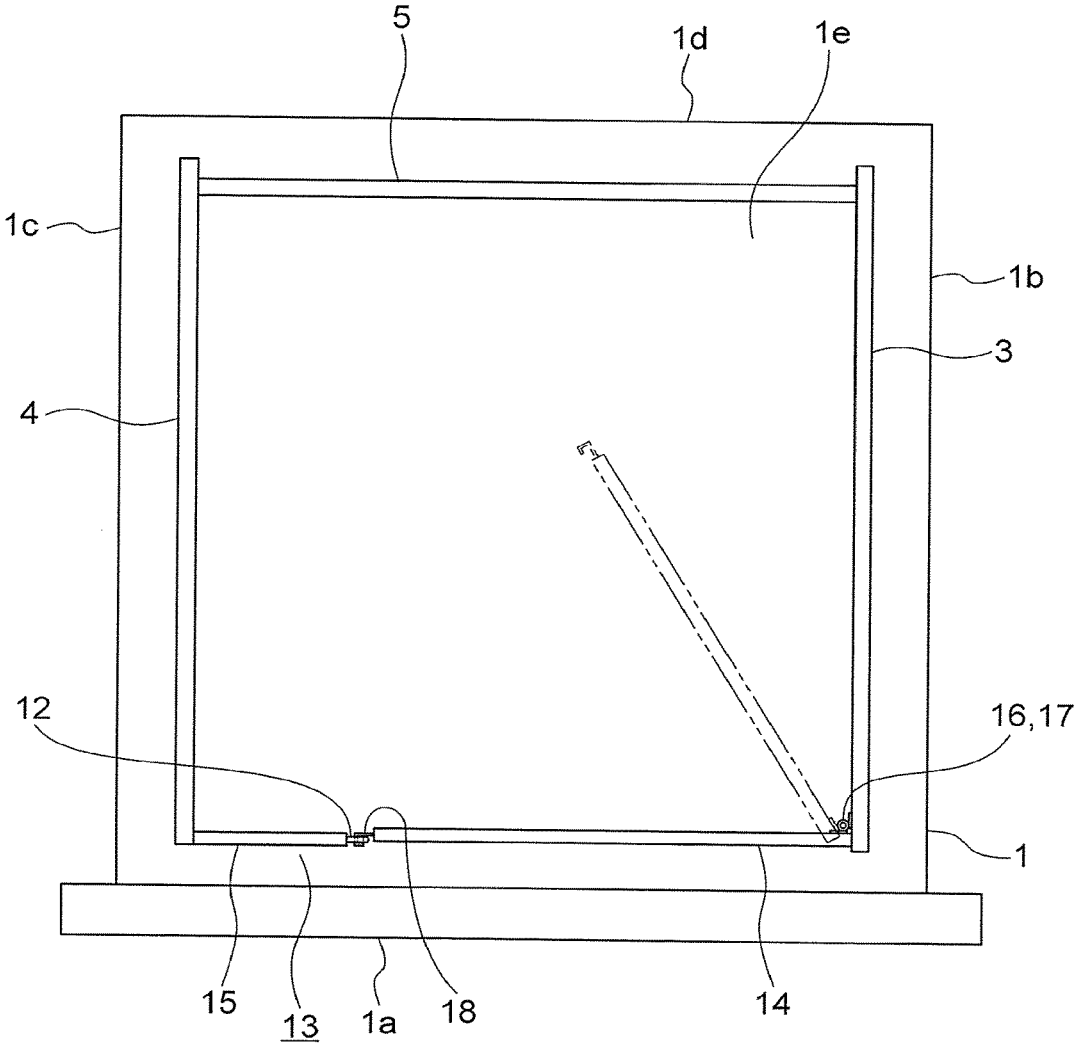
FIG. 9 is a plan view showing an elevator car upper handrail apparatus according to a third embodiment of the present invention.
Figure 10:
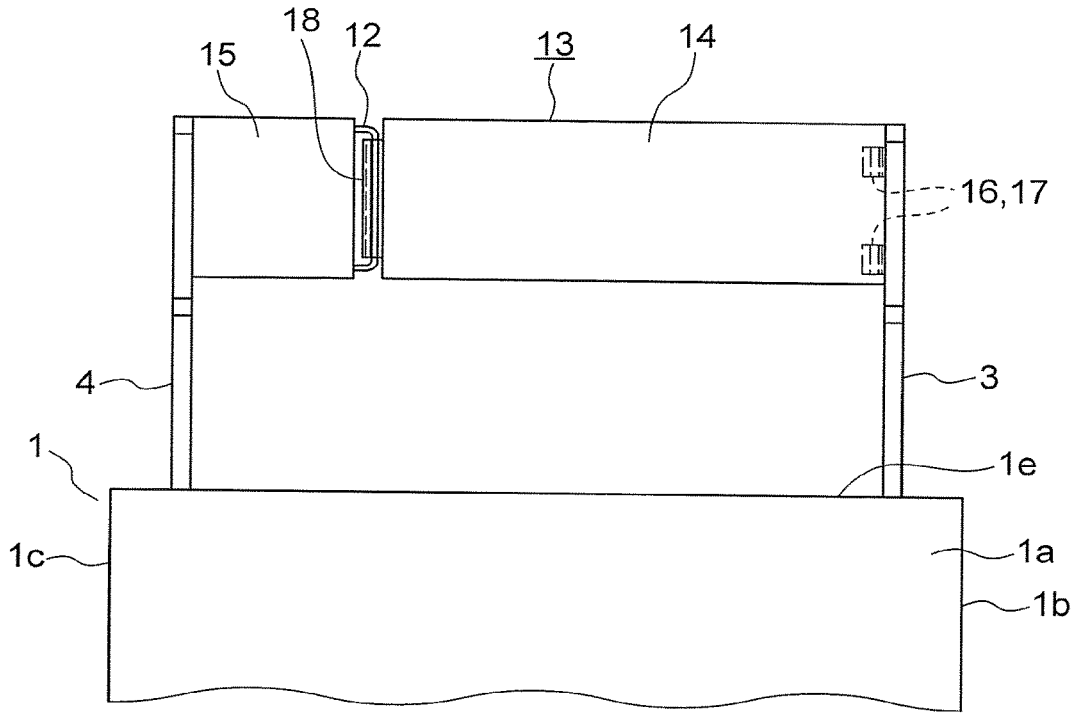
FIG. 10 is a front view of the car upper handrail apparatus shown in FIG. 9.

FIG. 9 is a plan view showing an elevator car upper handrail apparatus according to a third embodiment of the present invention, and FIG. 10 is a front view of the car upper handrail apparatus shown in FIG. 9. A connecting body 13 of the third embodiment includes a flat plate-shaped opening/closing member 14 and a flat plate-shaped fixed connecting member 15. A proximal end of the opening/closing member 14 is connected, so as to be rotatable, to the end of the first side handrail 3 on the landing side via a plurality of hinges 16.

The opening/closing member 14 is rotatable, about a vertical axis, between a closed position (the solid line shown in FIG. 9), in which the path for movement of a worker from the landing to the car upper surface 1*e* is intersected and closed by the opening/closing member 14 and an open position (the two-dot chain line shown in FIG. 9), in which the path for movement is opened by the opening/closing member 14. The opening/closing member 14 is normally in the closed position, but rotates towards an open position due to being pushed by a worker.

Further, a plurality of torsion springs 17 which apply, to the opening/closing member 14, a force to return the opening/closing member 14 to the closed position, are provided at the proximal end of the opening/closing member 14.

A proximal end of the fixed connecting member 15 is fixed perpendicularly to the second side handrail 4. In other words, the fixed connecting member 15 does not rotate with respect to the second side handrail 4. The dimension of the fixed connecting member 15 in the width direction of the car 1 is smaller than that of the opening/closing member 14 in the width direction.

A first connecting portion 18 is fixed to the distal end of the opening/closing member 14. The first connecting portion 18 has the same shape as the first connecting portion 11 of the second embodiment except with the second hook portion 11*c* removed therefrom. A second connecting portion 12 similar to that of the second embodiment is fixed to the distal end of the fixed connecting member 15. All other configurations and operations are similar or identical to the second embodiment.

Such a connecting body 13 also allows the strength required of the first and second side handrails 3 and 4 to be more reliably secured while the weight thereof is reduced, and allows a decline in workability, when a worker enters/exits the car upper surface 1*e*, to be prevented.

Moreover, as only one opening/closing member 14 is used, fewer hinges 16 and torsion springs 17 have to be used.

Note that, in the third embodiment, the side handrail on the right side when viewed from the landing side is set as the first side handrail, however, the left side handrail may be set as the first side handrail and the right side handrail set as the second side handrail.

Further, the dimensional balance between the opening/closing member and the fixed connecting member is not limited to the example described above, and the dimension of the fixed connecting member in the width direction of the car 1 may be set to be the same as the dimension of the opening/closing member in the width direction, or may be set to be larger than the dimension of the opening/closing member in the width direction.

Further, in the third embodiment, the proximal end of the opening/closing member 14 is directly connected to the first side handrail 3, however, a fixed connecting member may also be fixed to the first side handrail side, and the proximal end of the opening/closing member may be connected, so as to be rotatable, to the distal end of the fixed connecting member. In other words, the opening/closing member may be connected to the first side handrail via a fixed connecting member.

Fourth Embodiment

Figure 11:
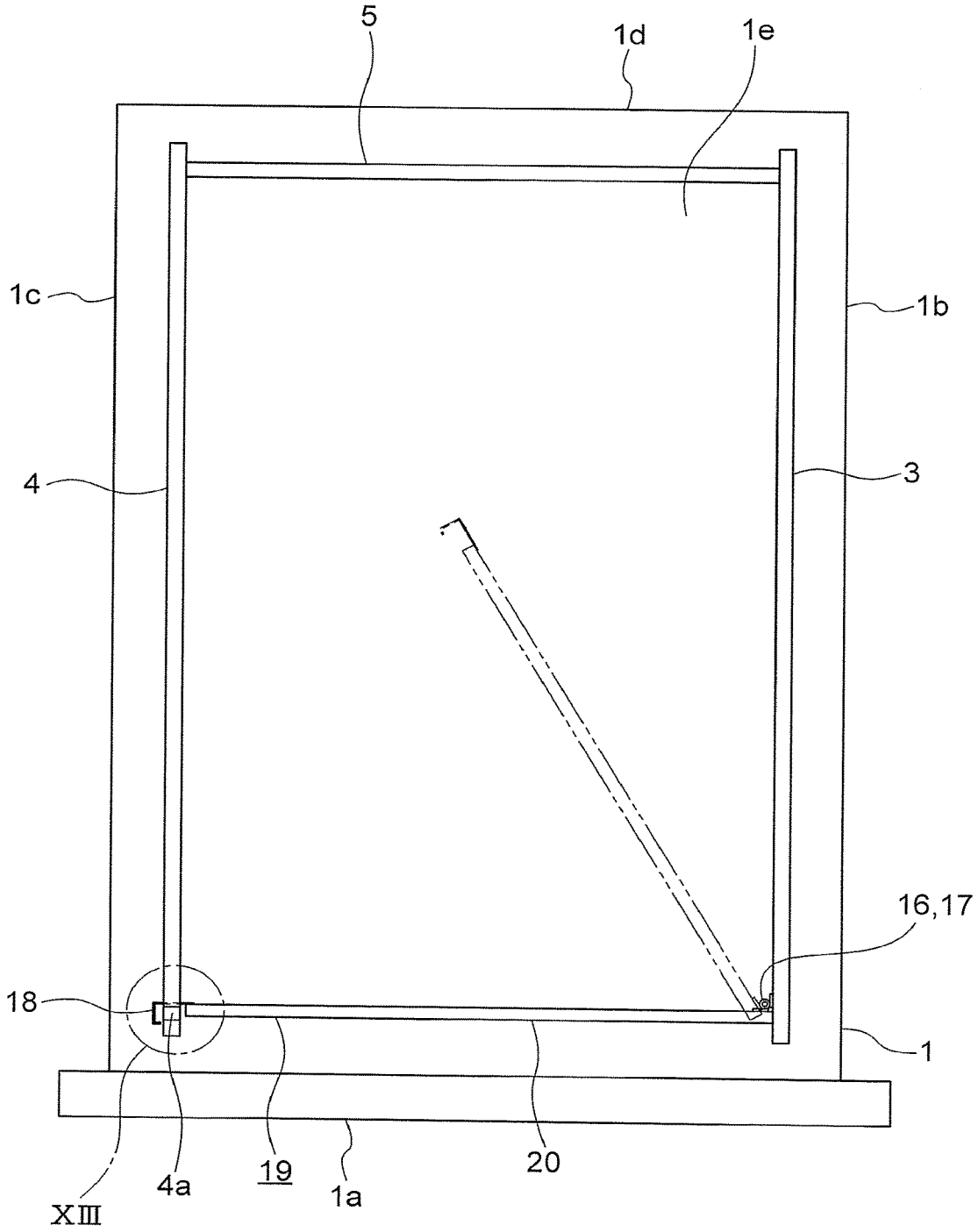
FIG. 11 is a plan view showing an elevator car upper handrail apparatus according to a fourth embodiment of the present invention.
Figure 12:
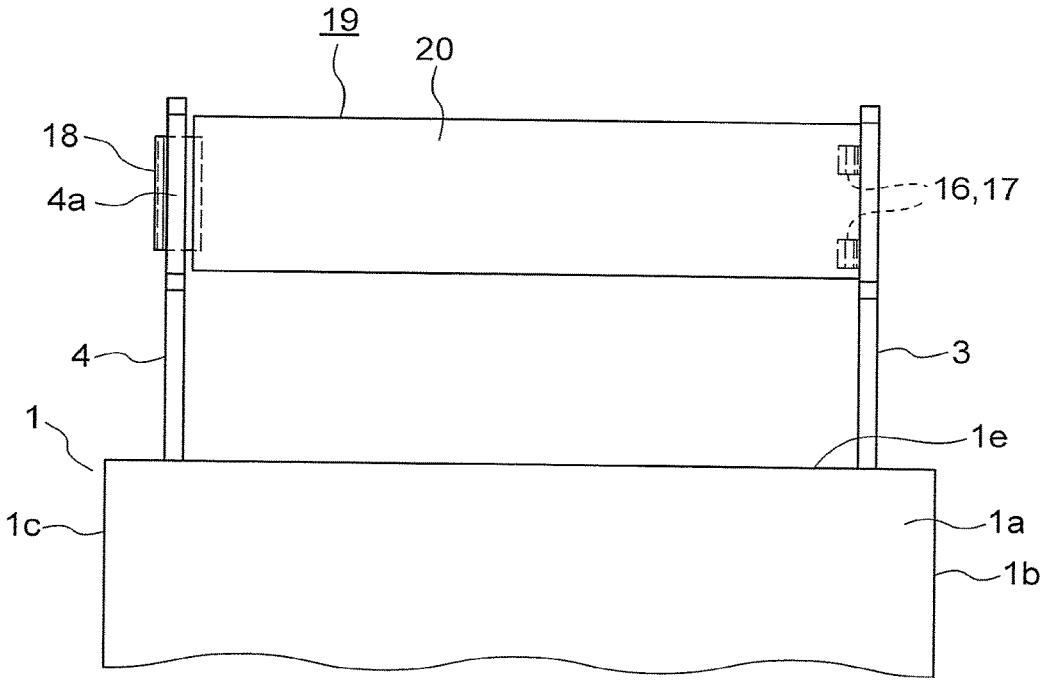
FIG. 12 is a front view of the car upper handrail apparatus shown in FIG. 11.
Figure 13:
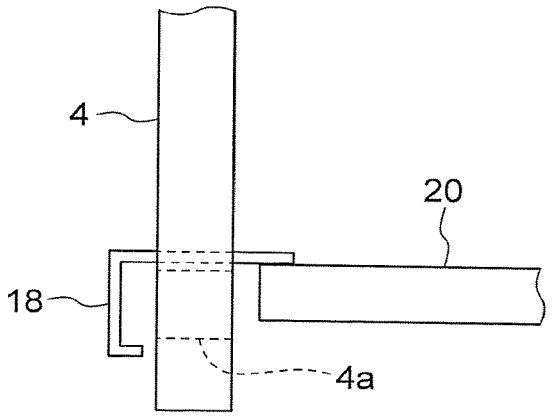
FIG. 13 is an enlarged plan view of portion XIII shown in FIG. 11.

FIG. 11 is a plan view showing an elevator car upper handrail apparatus according to a fourth embodiment of the present invention, FIG. 12 is a front view of the car upper handrail apparatus shown in FIG. 11, and FIG. 13 is an enlarged plan view of portion XIII shown in FIG. 11.

A connecting body 19 of the fourth embodiment includes an opening/closing member 20. A proximal end of the opening/closing member 20 is connected, so as to be rotatable, to the end of the first side handrail 3 on the landing side via the hinges 16 in the same way as in the third embodiment.

The opening/closing member 20 is rotatable, about a vertical axis, between a closed position (the solid line shown in FIG. 11), in which the path for movement of a worker from the landing to the car upper surface 1*e* is intersected and closed by the opening/closing member 20 and an open position (the two-dot chain line shown in FIG. 11), in which the path for movement is opened by the opening/closing member 20. The opening/closing member 20 is normally in the closed position, but rotates towards an open position due to being pushed by a worker.

Further, similarly to the third embodiment, torsion springs 17 which apply, to the opening/closing member 20, a force to return the opening/closing member 20 to the closed position, are provided at the proximal end of the opening/closing member 20.

A first connecting portion 18, which is similar to that of the third embodiment, is fixed to a distal end of the opening/closing member 20. A second connecting portion 4*a*, which is a portion of a vertical pillar of the second side handrail 4, is provided in an area that is overlapped by the first connecting portion 18 when the opening/closing member 20 is in the closed position. All other configurations and operations are similar or identical to the third embodiment.

Such a connecting body 19 also allows the strength required of first and second side handrails 3 and 4 to be more reliably secured while the weight thereof is reduced, and allows a decline in workability, when a worker enters/exits the car upper surface 1*e*, to be prevented.

Moreover, as only one opening/closing member 20 is used, fewer hinges 16 and torsion springs 17 have to be used.

Further, as no fixed connecting member is used, the number of components can be further reduced.

Note that, in the fourth embodiment, the side handrail on the right side when viewed from the landing side is set as the first side handrail, however, the left side handrail may be set as the first side handrail and the right side handrail set as the second side handrail.

Further, in the fourth embodiment, the proximal end of the opening/closing member 20 is directly connected to the first side handrail 3, however, a fixed connecting member similar to that of the third embodiment may be fixed to the first side handrail side, and the proximal end of the opening/closing member may be connected, so as to be rotatable, to the distal end of the fixed connecting member. In other words, the opening/closing member may be connected to the first side handrail via a fixed connecting member.

Further, in the first to fourth embodiments, the torsion springs are indicated as a mechanism for automatically returning the opening/closing member to the closed position, however, the mechanism is not limited thereto. For example, a mechanism may be used in which a weight is raised when the opening/closing member rotates towards the open position, such that the opening/closing member automatically returns to the closed position under the weight of the weight.

Further, the first and second connecting portions of the first to fourth embodiments may each be divided into two or more connecting portions in the vertical direction.

Fifth Embodiment

Figure 14:
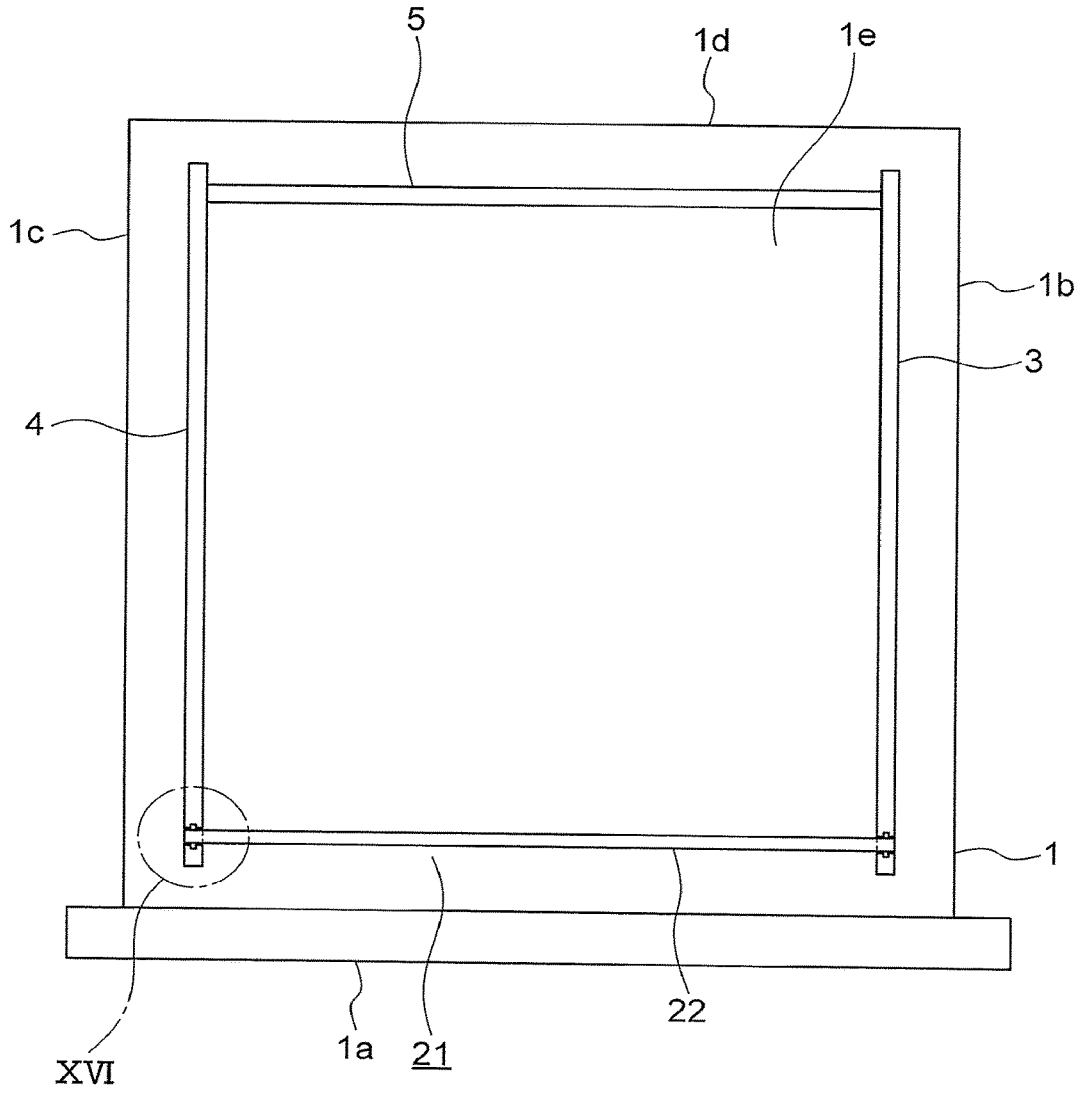
FIG. 14 is a plan view showing an elevator car upper handrail apparatus according to a fifth embodiment of the present invention.
Figure 15:
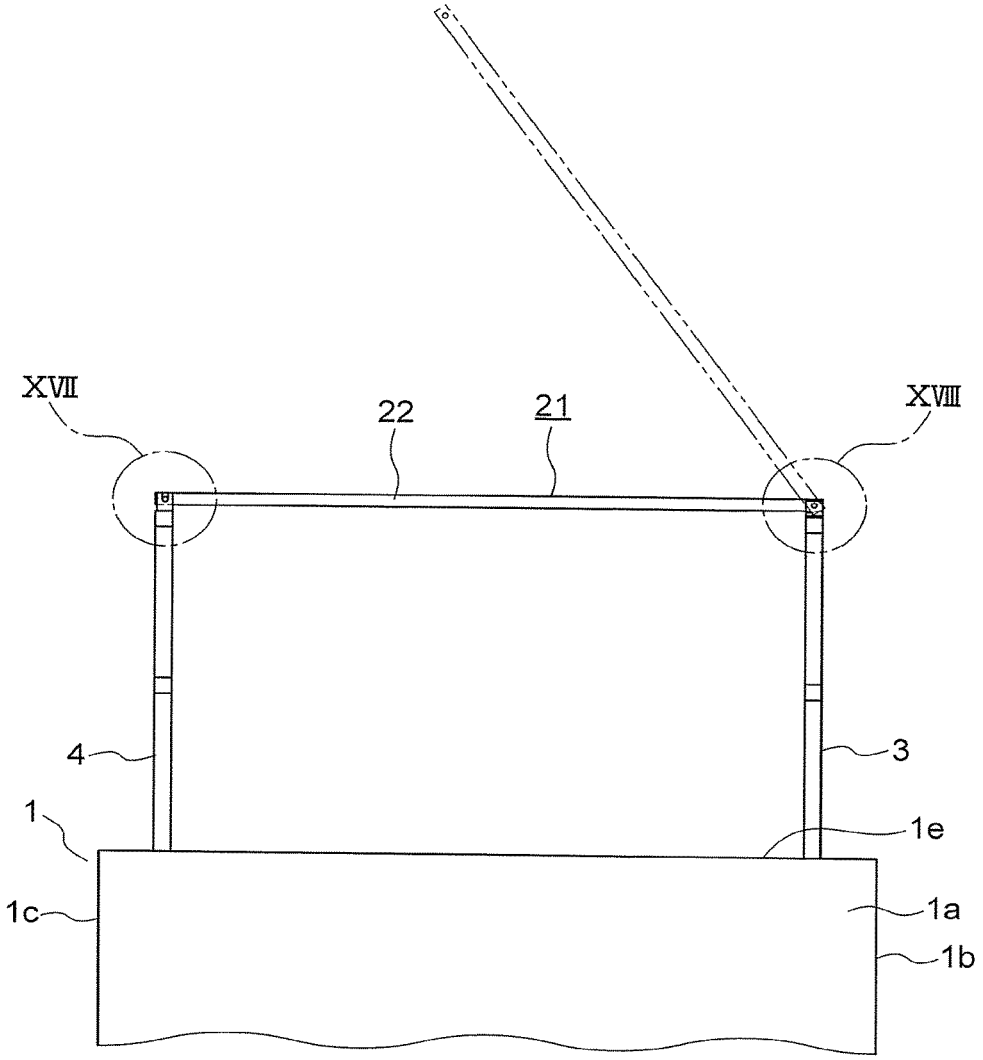
FIG. 15 is a front view of the car upper handrail apparatus shown in FIG. 14.

FIG. 14 is a plan view showing an elevator car upper handrail apparatus according to a fifth embodiment of the present invention, and FIG. 15 is a front view of the car upper handrail apparatus shown in FIG. 14. A connecting body 21 of the fifth embodiment includes a rod-shaped opening/closing member 22. A proximal end of the opening/closing member 22 is connected, so as to be rotatable, to the first side handrail 3.

The opening/closing member 22 is rotatable between a closed position (the solid line shown in FIG. 15), in which the path for movement of a worker from the landing to the car upper surface 1*e* is intersected and closed by the opening/closing member 22 and an open position (the two-dot chain line shown in FIG. 15), in which the path for movement is opened by the opening/closing member 22. The open position is a position at which the opening/closing member 22 has been rotated upward from the closed position. The rotation angle of the opening/closing member 22 is limited to less than 90°. Further, the opening/closing member 22 automatically returns to the closed position due to the own weight of the opening/closing member 22, when an external force that acts to rotate the opening/closing member 22 towards an open position is removed.

Figure 16:
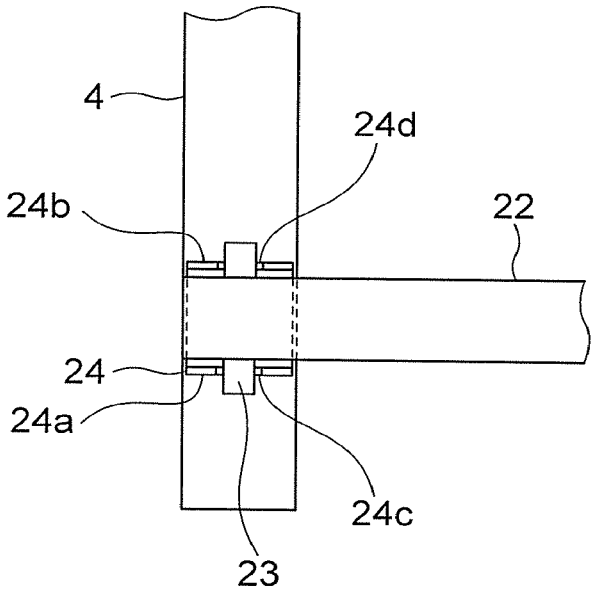
FIG. 16 is an enlarged plan view of portion XVI shown in FIG. 14.
Figure 17:
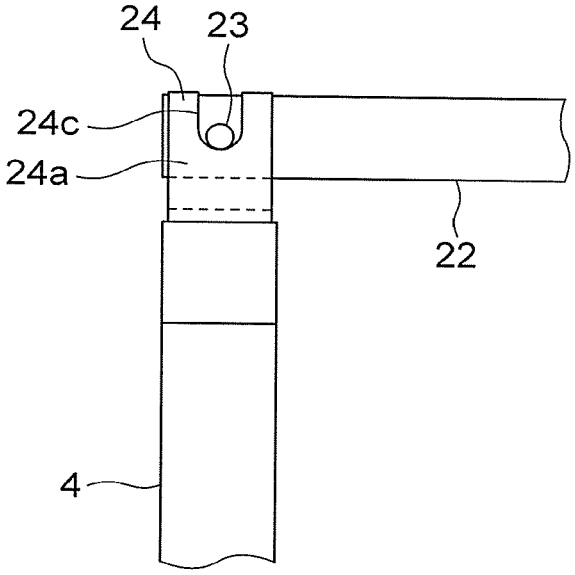
FIG. 17 is an enlarged front view of portion XVII shown in FIG. 15.

FIG. 16 is an enlarged plan view of portion XVI shown in FIG. 14, and FIG. 17 is an enlarged front view of portion XVII shown in FIG. 15. A horizontal coupling rod (catching fitting) 23, which serves as a first connecting portion, is fixed to the distal end of the opening/closing member 22. A U-shaped connection fitting (catching fitting) 24, which serves as a second connecting portion, is fixed to the upper surface of the end of the second side handrail 4 on the landing side.

The connection fitting 24 includes a pair of mutually opposing wall portions 24*a* and 24*b*. When the opening/closing member 22 is in the closed position, the distal end of the opening/closing member 22 is inserted between the wall portions 24*a* and 24*b*. A pair of grooves 24*c* and 24*d* are respectively provided in the wall portions 24*a* and 24*b*. When the opening/closing member 22 is in the closed position, the coupling rod 23 is inserted into the grooves 24*c* and 24*d*.

The width dimension of the grooves 24*c* and 24*d* is set to be larger than the diameter of the coupling rod 23. For this reason, the coupling rod 23 and the grooves 24*c* and 24*d* allow the opening/closing member 22 to rotate.

Figure 18:
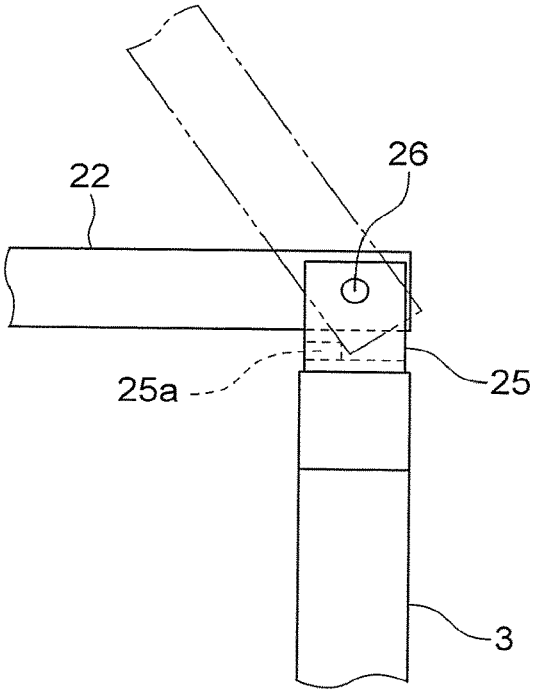
FIG. 18 is an enlarged front view of portion XVIII shown in FIG. 15.

FIG. 18 is an enlarged front view of portion XVIII shown in FIG. 15. A U-shaped attachment fitting 25 is fixed to the upper surface of the end of the first side handrail 3 on the landing side. A horizontal rotating shaft 26 is provided at the proximal end of the opening/closing member 22. The opening/closing member 22 is connected to the attachment fitting 25 so as to be rotatable about the rotating shaft 26.

A stopper 25*a* for limiting the rotation angle of the opening/closing member 22 is provided at an inner side of the attachment fitting 25. When the opening/closing member 22 is in the open position, the proximal end of the opening/closing member 22 comes into contact with the stopper 25*a*.

Figure 19:
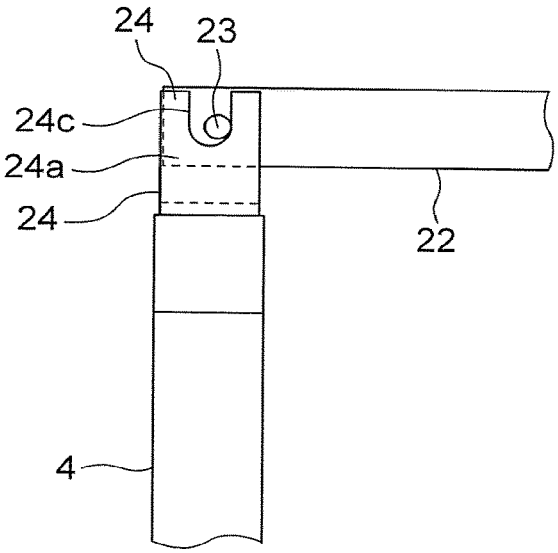
FIG. 19 is a front view of a state in which the opening/closing member shown in FIG. 17 is displaced towards a first side handrail side.

FIG. 19 is a front view of a state in which the opening/closing member 22 shown in FIG. 17 is displaced towards a first side handrail 3. In this state, the coupling rod 23 comes into contact with the inner surfaces of the grooves 24*c* and 24*d*, such that an external force applied in the width direction of the car 1 is transmitted between the coupling rod 23 and the connection fitting 24.

Accordingly, the configuration according to the fifth embodiment also allows the strength required of first and second side handrails 3 and 4 to be more reliably secured while the weight thereof is reduced, and allows a decline in workability, when a worker enters/exits the car upper surface 1*e*, to be prevented.

Further, as the opening/closing member 22 returns to the closed position due to the own weight of the opening/closing member 22, a member such as a torsion spring for returning the opening/closing member 22 to the closed position is not required.

Note that the type of elevators to which the present invention is applied is not particularly limited, and that the present invention may be applied to machine room-less elevators, elevators having a machine room, elevators having a 1:1 roping system, elevators having a 2:1 roping system, double deck elevators, one-shaft multi-car type elevators in which a plurality of cars are arranged in a common hoistway, and the like.

The invention claimed is:

1. An elevator car upper handrail apparatus comprising:

first and second side handrails erected respectively along left and right edges of a car upper surface when viewed from a landing side; and a connecting body provided between respective ends of the first and second side handrails on the landing side, wherein the connecting body includes an opening/closing member which is rotatable between a closed position, in which a path for movement of a worker from a landing to the car upper surface is closed by the opening/closing member and an open position, in which the path for movement is opened by the opening/closing member, the opening/closing member is configured to return automatically to the closed position, and when the opening/closing member is in the closed position, the connecting body transmits an external force applied to one of the first and second side handrails in the width direction of a car to the other of the first and second side handrails.

2. The elevator car upper handrail apparatus according to claim 1, wherein the opening/closing member is provided with a first connecting portion, a second connecting portion is provided in an area that is overlapped by the first connecting portion when the opening/closing member is in the closed position, and the first and second connecting portions allow the opening/closing member to rotate from the closed position to the open position, and the external force acting in the width direction of the car is transmitted between the first and second connecting portions.

3. The elevator car upper handrail apparatus according to claim 2, wherein the first connecting portion and the second connecting portion normally oppose each other via a gap in the width direction of the car, and are brought into contact with each other by at least one of the first and second side handrails being displaced in the width direction of the car.

4. The elevator car upper handrail apparatus according to claim 3, wherein the opening/closing member includes a first opening/closing member connected to the first side handrail and a second opening/closing member connected to the second side handrail, the first connecting portion is provided at a distal end of the first opening/closing member, and the second connecting portion is provided at a distal end of the second opening/closing member.

5. The elevator car upper handrail apparatus according to claim 3, wherein the opening/closing member is connected to the first side handrail, the connecting body further includes a fixed connecting member fixed to the second side handrail, and the second connecting portion is provided on the fixed connecting member.

6. The elevator car upper handrail apparatus according to claim 3, wherein the opening/closing member is connected to the first side handrail, the first connecting portion is provided at a distal end of the opening/closing member, and the second connecting portion is provided at an end of the second side handrail on the landing side.

7. The elevator car upper handrail apparatus according to claim 2, wherein the opening/closing member includes a first opening/closing member connected to the first side handrail and a second opening/closing member connected to the second side handrail, the first connecting portion is provided at a distal end of the first opening/closing member, and the second connecting portion is provided at a distal end of the second opening/closing member.

8. The elevator car upper handrail apparatus according to claim 7, wherein the first connecting portion includes first and second hook portions which respectively project towards both sides of the opening/closing member in an opening/closing direction, and the second connecting portion includes a connecting rod which selectively opposes one of the first and second hook portions.

9. The elevator car upper handrail apparatus according to claim 8, further comprising:

a torsion spring which applies, to the opening/closing member, a force to return the opening/closing member to the closed position.

10. The elevator car upper handrail apparatus according to claim 7, further comprising:

a torsion spring which applies, to the opening/closing member, a force to return the opening/closing member to the closed position.

11. The elevator car upper handrail apparatus according to claim 2, wherein the opening/closing member is connected to the first side handrail, the connecting body further includes a fixed connecting member fixed to the second side handrail, and the second connecting portion is provided on the fixed connecting member.

12. The elevator car upper handrail apparatus according to claim 11, further comprising:

a torsion spring which applies, to the opening/closing member, a force to return the opening/closing member to the closed position.

13. The elevator car upper handrail apparatus according to claim 2, wherein the opening/closing member is connected to the first side handrail, the first connecting portion is provided at a distal end of the opening/closing member, and the second connecting portion is provided at an end of the second side handrail on the landing side.

14. The elevator car upper handrail apparatus according to claim 13, further comprising:

a torsion spring which applies, to the opening/closing member, a force to return the opening/closing member to the closed position.

15. The elevator car upper handrail apparatus according to claim 2, further comprising:

a torsion spring which applies, to the opening/closing member, a force to return the opening/closing member to the closed position.

16. The elevator car upper handrail apparatus according to claim 3, further comprising:

a torsion spring which applies, to the opening/closing member, a force to return the opening/closing member to the closed position.

17. The elevator car upper handrail apparatus according to claim 2, wherein the open position is a position at which the opening/closing member has been rotated upward from the closed position, the rotation angle of the opening/closing member is limited to less than 90°, and the opening/closing member automatically returns to the closed position due to the own weight of the opening/closing member.

18. The elevator car upper handrail apparatus according to claim 1, further comprising:

a torsion spring which applies, to the opening/closing member, a force to return the opening/closing member to the closed position.

19. The elevator car upper handrail apparatus according to claim 1, wherein the open position is a position at which the opening/closing member has been rotated upward from the closed position, the rotation angle of the opening/closing member is limited to less than 90°, and the opening/closing member automatically returns to the closed position due to the own weight of the opening/closing member.

* * * * *